US005191665A

United States Patent [19]

Breedlove

[11] Patent Number: 5,191,665

[45] Date of Patent: Mar. 9, 1993

[54] INFLATABLE CUSHION

[76] Inventor: Michael E. Breedlove, 7918 County Rd. #2, Howey-in-the-Hills, Fla. 34737

[21] Appl. No.: 682,312

[22] Filed: Apr. 9, 1991

[51] Int. Cl.[5] ..... A47C 27/00

[52] U.S. Cl. ..... 5/656; 5/462; 5/449

[58] Field of Search ..... 5/421, 441, 449, 462, 5/656

[56] References Cited

U.S. PATENT DOCUMENTS

| | | | |
|---|---|---|---|
| 2,216,818 | 10/1940 | Kuhlman | 5/449 |
| 2,792,576 | 5/1957 | Coady | 5/441 X |
| 2,804,911 | 9/1957 | Howarth . | |
| 3,204,678 | 9/1965 | Worcester | 5/441 X |
| 3,651,847 | 3/1972 | Casamassima | 5/441 X |
| 3,763,972 | 10/1973 | Karzmar . | |
| 3,840,918 | 10/1974 | Shave . | |
| 3,938,569 | 2/1976 | Hill . | |
| 4,096,929 | 6/1978 | Frey . | |
| 4,116,310 | 9/1978 | Shields | 5/462 X |
| 4,193,152 | 3/1980 | Seibold, Jr. | 5/434 |
| 4,206,945 | 6/1980 | Kifferstein | 5/434 |
| 4,445,240 | 5/1984 | Voorhees | 5/441 X |
| 4,573,447 | 3/1986 | Thrash et al. . | |
| 4,604,987 | 8/1986 | Keltner | 5/462 X |
| 4,688,286 | 8/1987 | Miker, Jr. | 5/434 |
| 4,783,120 | 11/1988 | Kiechlin | 5/462 X |
| 4,783,866 | 11/1988 | Simmons et al. | 5/441 |
| 4,863,003 | 9/1989 | Carter | 5/462 X |
| 4,914,765 | 4/1990 | Smith | 5/441 X |

FOREIGN PATENT DOCUMENTS

| | | | |
|---|---|---|---|
| 1061480 | 8/1979 | Canada | 5/441 |
| 2410624 | 9/1975 | Fed. Rep. of Germany | 5/449 |
| 271655 | 2/1930 | Italy | 5/441 |

*Primary Examiner*—Renee S. Luebke
*Assistant Examiner*—Michael J. Milano
*Attorney, Agent, or Firm*—Jacobson, Price, Holman & Stern

[57] ABSTRACT

An inflatable cushion for use by those engaged in various sports activities such as boating, hunting, fishing, canoeing or a spectator attending various sporting events. The inflatable cushion includes a generally circular outer covering or envelope having an openable and closable side edge portion provided with a closure structure with an inflatable annular tube being positioned into the outer cover through the openable edge portion to provide an effective cushion for a user. The outer cover is provided with a shoulder strap to facilitate the device being carried to a point of use and also useable to secure the cushion to a stadium seat, boat or canoe seat, tree stand or the like. The exterior of the outer cover is also provided with a pocket to receive a relatively thin, flexible heating unit to enhance the comfort of those using the cushion especially during cold weather.

1 Claim, 1 Drawing Sheet

INFLATABLE CUSHION

BACKGROUND OF THE INVENTION

1. FIELD OF THE INVENTION

The present invention generally relates to a cushion positionable between a supporting surface and a person supportingly engaged by the supporting surface. More specifically, the invention is an inflatable cushion for use by those engaged in various sports activities such as boating, hunting, fishing, canoeing or a spectator attending various sporting events. The inflatable cushion includes a generally circular outer covering or envelope having an openable and closable side edge portion provided with a closure structure with an inflatable annular tube being positioned into the outer cover through the openable edge portion to provide an effective cushion for a user. The outer cover is provided with a shoulder strap to facilitate the device being carried to a point of use and also useable to secure the cushion to a stadium seat, boat or canoe seat, tree stand or the like. The exterior of the outer cover is also provided with a pocket to receive a relatively thin, flexible heating unit to enhance the comfort of those using the cushion especially during cold weather.

2. DESCRIPTION OF THE PRIOR ART

Various cushions have been provided to be used by individuals when setting on a supporting surface with the prior patents including cushions constructed of resilient material as well as inflatable cushions. The following U.S. patents relate to this field of endeavor.

U.S. Pat. No. 2,804,911
U.S. Pat. No. 3,763,972
U.S. Pat. No. 3,840,918
U.S. Pat. No. 3,938,569
U.S. Pat. No. 4,096,929
U.S. Pat. No. 4,116,310
U.S. Pat. No. 4,573,447
U.S. Pat. No. 4,783,120
U.S. Pat. No. 4,783,866

However, the prior patents do not disclose the combination of features incorporated into this invention including the specific construction and configuration of the outer cover or envelope and the inflatable cushion combined with the openable peripheral edge portion secured together by hook and loop pile fastener arrangement such as sold under the trademark "Velcro", a shoulder strap and pocket for a warming unit for use in cold weather.

SUMMARY OF INVENTION

An object of the present invention is to provide an inflatable cushion of circular configuration and including an outer cover or envelope constructed of strong and durable fabric-like material joined together peripherally but provided with an openable peripheral edge portion for insertion and removal of an annular inflatable tube with the openable peripheral edge portion being retained in closed relation by the use of hook and loop fastener arrangements such as available under the trademark "Velcro".

Another object of the invention is to provide an inflatable cushion in accordance with the preceding object in which outer cover is provided with an elongated shoulder strap having the ends thereof secured to the peripheral edge of the envelope immediately adjacent the end portions of the openable peripheral edge section to support the cushion with the openable peripheral edge portion facing upwardly when the shoulder strap is engaged with the shoulder of a user to facilitate the inflatable cushion being carried to a point of use with the shoulder strap also being utilized to anchor the cushion in position on a seat, tree stand or in any other location in which it is desired to use the cushion.

A further object of the invention is to provide an inflatable cushion in which the central exterior of one surface of the outer cover is provided with a generally rectangular patch-type pocket having an open end for insertion and removal of a heating unit which will enhance the comfort of the user when the cushion is being used in cold weather.

Still another object of the invention is to provide an inflatable cushion which is dependable and long lasting and relatively inexpensive to manufacture and also easy to handle and carry to a point of use with the shoulder strap serving multiple purposes of enabling the device to be easily carried and also anchor the device in a desired position such as on a boat seat, stadium seat or tree stand seat with the shoulder strap retaining the cushion in proper position on the seat thereby avoiding the usual problem of a cushion sliding on the seat and falling off the seat when the user stands which can occur frequently during various sporting activities.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
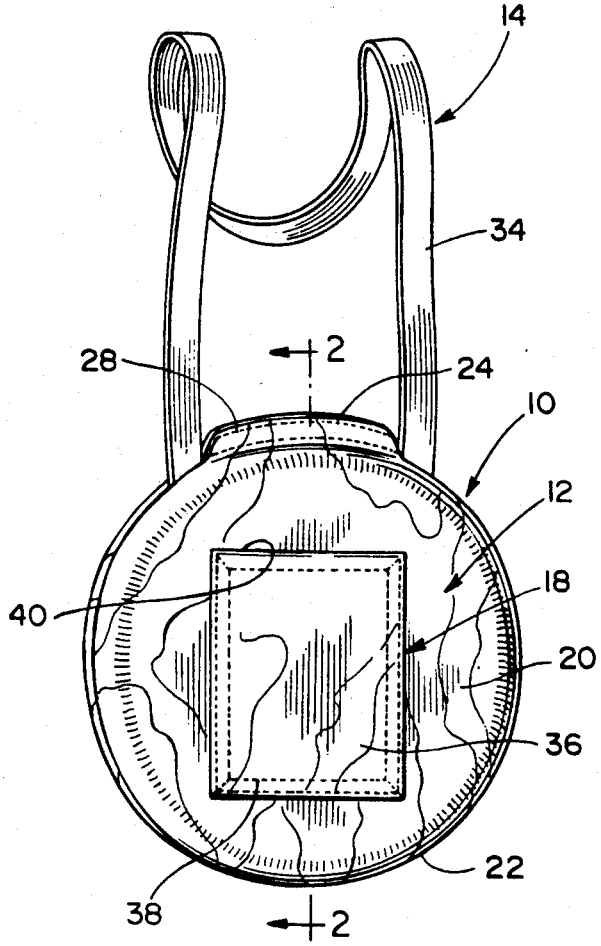
FIG. 1 is a perspective view of the inflatable cushion of the present invention.
Figure 2:
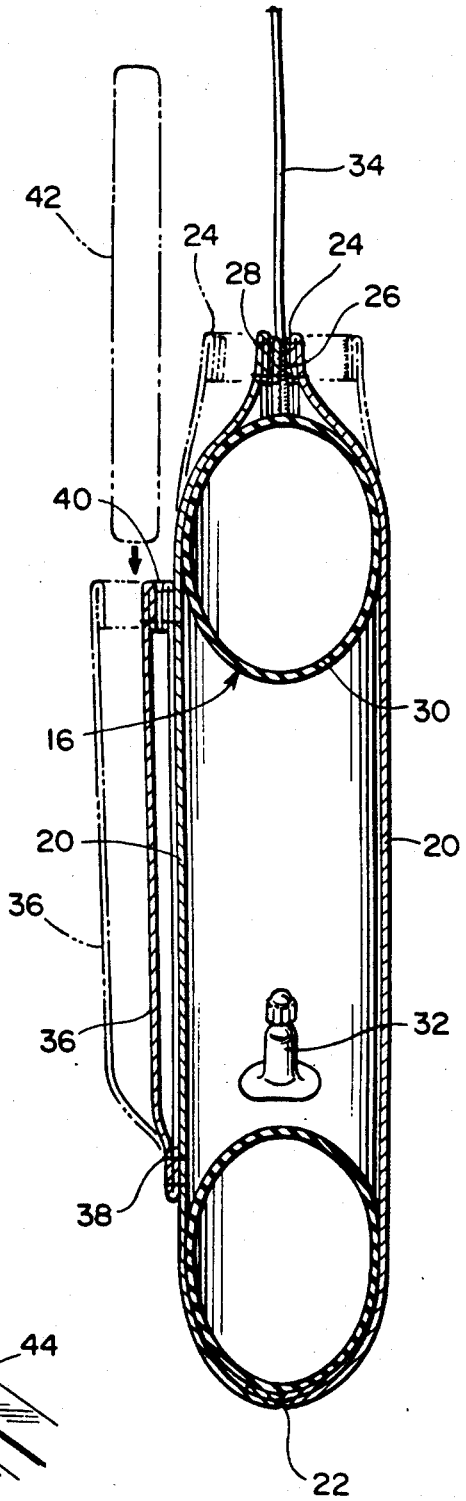
FIG. 2 is a vertical sectional view, on an enlarged scale, taken substantially upon a plane passing along section line 2—2 on FIG. 1 illustrating the specific structural details of the invention.

Referring now specifically to the drawings, the inflatable cushion of the present invention is generally designated by reference numeral 10 and includes an outer envelope generally designated by reference numeral 12, a shoulder strap 14, an annular inflatable tube 16 and an external pocket 18. The outer cover 12 includes a pair of circular panels 20 of flexible fabric-like material such as an aramid fiber available under the trademark "Kevlar" which may be of any color of provided with a pattern or design thereon such as camouflage coloring. The periphery of the panels 20 are connected by an inturned seam or stitching 22 but a portion of the periphery of the panels projects laterally and forms an openable entrance area 24 that is secured detachably together by hook and loop fastener strips 26 such as available under the trademark "Velcro". The outer edge of the projecting portion of the panel is provided with a hem formed by stitching 28 thus forming a peripheral edge portion which can be opened or closed and extends for a relatively short portion of the periphery of the outer cover as illustrated in FIG. 1.

The inflatable tube 16 is an annular resilient, flexible member 30 having an inflation valve 32 which extends inwardly into the interior of the ring formed by the annular inflatable member 30. The peripheral edge potion which can be opened enables insertion and removal of the annular tube 30 which can be inserted into the envelope or cover 12 when deflated or only partially inflated with the inflation valve 32 enabling inflation to a desired pressure after insertion into the outer cover. The inflatable tube 30 may be constructed of rubber or plastic material such as commonly used in an inner tube for pneumatic tires and the inflatable valve 32 may be a conventional Schraeder valve.

The shoulder strap 14 includes an elongated flexible strap 34 constructed of fabric webbing or other similar flexible, non-resilient and sturdy material with the ends of the strap 34 being inserted into the seam or stitching 22 at each end of the openable edge proton 24 of the outer cover 12 as illustrated in FIG. 1 thereby showing that when the strap 34 is engaged with the shoulder with the remainder of the cushion 10 suspended therefrom, the openable edge portion 24 will be facing upwardly to facilitate access thereto if necessary.

The exterior pocket 18 includes a panel of fabric-like material 36 of the same material used to construct the panels 20. The pocket panel 36 is secured to the outer surface of one of the panels 20 along three edges thereof by stitching 38 thus forming a patch pocket with the unattached end of the panel 36 defining an opening 40 to receive a heating unit 42 which is a commercially available chemical-type warming unit that is flexible and relatively thin item which can be inserted into the external pocket 18 formed by the generally rectangular fabric-like panel 36 with it being pointed out that the opening 40 in the pocket 18 faces upwardly adjacent the peripheral openable edge portion 24 when the cushion is supported by the shoulder strap thus tending to retain the heating unit 42 in the pocket.

Figure 3:
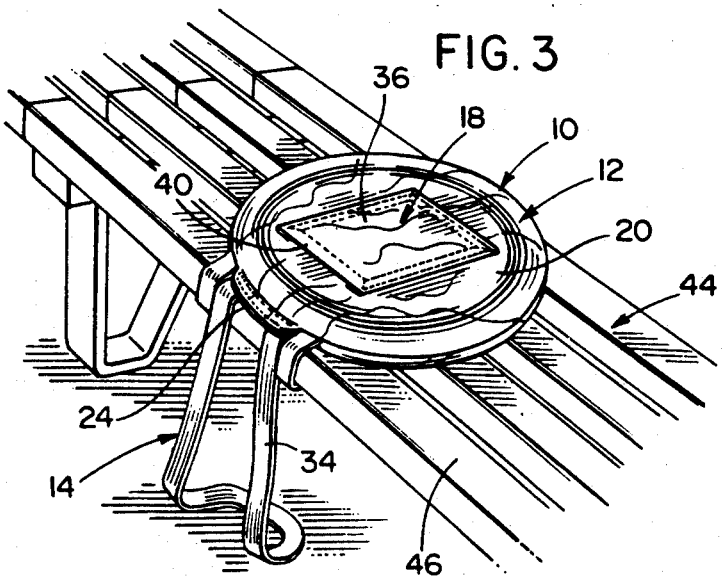
FIG. 3 is a perspective view of the inflatable cushion of the present invention associated with and anchored to a stadium seat.

FIG. 3 illustrates one use of the invention in association with a stadium seat 44 in which the pocket 18 is facing upwardly and the shoulder strap 14 has been used to wrap around one of the slats 46 forming the seat 44. The shoulder strap 18 can be tied or otherwise secured to the seat 44 to anchor the cushion 10 in place on the seat 44 to retain it in place even though the person using the cushion may stand up such as occurs frequently when attending a sporting event such as a football game or the like. By tieing the shoulder straps around the slats or the seat, the shoulder strap will be out of the way and not subject to becoming soiled by engagement with an underlying support surface or by being stepped upon by other spectators. The anchor strap 18 can also be used to secure the cushion 10 to other seats or surfaces such as a boat seat, canoe seat or the seat on a tree stand while hunting and in any other area where a person is likely to engage a supporting surface while sitting.

Constructing the outer cover of a rugged fabric-like material provides a dependable long lasting cushion. The cushion may be provided with various colors or designs including the various color schemes and logos used by teams engaged in various sports. If the cushion is used by hunters, it can be constructed with a camouflage color design on the exterior thereof or it may be blaze orange to enhance the safety aspects of a hunter by enabling other hunters to recognize that a moving object in the woods is another hunter rather than targeted game.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed is:

1. An inflatable seat cushion comprising an outer cover consisting of a pair of substantially circular panels constructed of flexible, fabric-like material, means securing a major portion of the periphery of the panels together to form an outer cover with substantially less than one-half of the periphery of the panels being openable, closure means for the openable portion of the periphery of the panels, an inflatable annular tube positioned interiorly of the outer cover with the openable portion of the periphery of the panels enabling insertion and removal of the inflatable tube and a shoulder strap attached to said outer cover to form a support for the cushion when transporting to a point of use, said shoulder strap being an elongated flexible strap of wedging material having the ends thereof secured to the periphery of the panels adjacent the ends of the openable portion of the periphery, said shoulder strap having a length to enable it to encircle and be anchored to a seat, a pocket forming panel secured to the exterior surface of one of said cover forming panels, said pocket forming panel being of rectangular construction and secured to the cover forming panel by stitching along three sides thus forming a pocket having an open side which faces the openable portion of the periphery of the cover forming panels to enable the open side of the pocket to face upwardly when the cushion is supported by the shoulder, strap a heating unit removably positioned in the pocket to form a warm surface upon which to set, said annular tube including an inflation and deflation valve extending into a central open area of the tube in spaced relation to the cover forming panels, said pocket forming panel being centrally located on said one cover forming panel, said pocket forming panel being aligned with the central open area of the tube, said inflatable tube and cover forming panels being dimensioned such that the cover forming panels will be maintained generally parallel and taut by the inflated tube, the openable portion of the periphery of the cover forming panels being defined by a portion of the peripheral edge of each cover forming panel projecting laterally outwardly to form an openable entrance with the inner surfaces of the laterally projecting edge portions of the cover forming panels facing inwardly, said closure means including hook and loop pile fasteners on the opposing surfaces of the laterally projecting edge portions of the cover forming panels, said shoulder strap having the ends thereof mounted immediately adjacent the ends of the laterally projecting edge portions of the cover forming panels.

* * * * *